US010584529B2

(12) United States Patent
Garcia Garcia

(10) Patent No.: US 10,584,529 B2
(45) Date of Patent: Mar. 10, 2020

(54) SAFETY DEVICE FOR A CHAIN OF A SHADE

(71) Applicant: Bandalux Industrial, S.A., Granollers (ES)

(72) Inventor: Emiliano Garcia Garcia, Granollers (ES)

(73) Assignee: Bandalux Industrial, S.A., Granollers (ES)

( * ) Notice: Subject to any disclaimer, the term of this patent is extended or adjusted under 35 U.S.C. 154(b) by 110 days.

(21) Appl. No.: 15/704,000

(22) Filed: Sep. 14, 2017

(65) Prior Publication Data

US 2019/0040678 A1 Feb. 7, 2019

(30) Foreign Application Priority Data

Aug. 4, 2017 (ES) ..... 201730944

(51) Int. Cl.

| | |
|---|---|
| ***E06B 9/78*** | (2006.01) |
| ***E06B 9/326*** | (2006.01) |
| ***E06B 9/42*** | (2006.01) |
| ***E06B 9/324*** | (2006.01) |

(52) U.S. Cl.

CPC ..... *E06B 9/326* (2013.01); *E06B 9/324* (2013.01); *E06B 9/42* (2013.01); *E06B 9/78* (2013.01); *E06B 2009/3265* (2013.01); *E06B 2009/785* (2013.01)

(58) Field of Classification Search

CPC .... E06B 9/326; E06B 2009/3265; E06B 9/78; E06B 9/324; E06B 9/325; E06B 9/42; E06B 2009/785; E06B 9/322; Y10T 24/3904; Y10T 24/3984

See application file for complete search history.

(56) References Cited

U.S. PATENT DOCUMENTS

| | | | | |
|---|---|---|---|---|
| 5,553,650 | A * | 9/1996 | Jelic | E06B 9/326 16/442 |
| 10,006,245 | B1 * | 6/2018 | Marocco | E06B 9/78 |
| 2008/0251622 | A1 * | 10/2008 | Randall | E06B 9/326 242/375.2 |
| 2012/0160431 | A1 * | 6/2012 | Cannaverde | E06B 9/326 160/340 |
| 2012/0211180 | A1 * | 8/2012 | Lin | E06B 9/326 160/368.1 |
| 2015/0197983 | A1 * | 7/2015 | Nicolosi | E06B 9/264 160/107 |
| 2016/0168907 | A1 * | 6/2016 | Byun | E06B 9/326 160/178.2 |

* cited by examiner

*Primary Examiner* — Katherine W Mitchell
*Assistant Examiner* — Jeremy C Ramsey

(57) ABSTRACT

The safety device for a chain of a shade.
The invention proposes the development of a tamper-proof safety device configured for a chain of a shade, such as the roller type, which, when not being used, is fixed to the body of the chain, and when being used, the chain is free to slide in order to perform the raising and lowering operations of the roller shade.

10 Claims, 7 Drawing Sheets

SAFETY DEVICE FOR A CHAIN OF A SHADE

RELATED APPLICATION

This application claims the benefit of priority of Spanish Patent Application No. 201730944 filed Aug. 4, 2017, the contents of which are incorporated herein by reference in their entirety.

FIELD AND BACKGROUND OF THE INVENTION

The object of the present application is to register a safety device for a shade, the shade being of the type that is actuated by means of a chain.

More specifically, the invention proposes the development of a tamper-proof safety device configured for a chain of a shade, such as the roller type, which, when not being used, is fixed to the body of the chain, and when being used, the chain is free to slide in order to perform the raising and lowering operations of the roller shade.

Safety devices for preventing accidents with chains or cords used for actuating the movement of a roller shade, panel or similar are well known in the state of the art. Such devices are configured to be fixed to a vertical wall, such that the chain or cord cannot freely rock or sway and is situated close to the wall in a substantially tensioned manner, thereby preventing a child from accidentally strangling him or herself with the cord or chain.

U.S. Pat. No. 9,091,117 and US 2011/0036517 describe safety devices that aim to solve the aforementioned problem.

In practice, it has been observed that these safety devices available on the market can have several drawbacks, among which is inviolability, meaning a user could relatively easily release or break the safety device, causing the chain of the cord to freely rock or sway. Another drawback is that, currently on the market there are chains for shades which have a stop element that is oversized with respect to the rest of the chain. This implies that a large number of safety devices cannot be used given that they do not allow this stop element to pass through the safety device, as is the case, for example, with the device described in United States Patent US 2001/0036517.

Another problem is that, in the case of tamper-proof devices, when said devices are placed on the chain, before being installed in a wall, they can slide freely, which may be bothersome during transportation operations, and they can be exposed to undesired blows.

Therefore, there is still a need for a safety device that satisfactorily solves the aforementioned drawbacks.

Moreover, the applicant is currently unaware of the existence of an invention having all the characteristics described herein.

SUMMARY OF THE INVENTION

The present invention has been developed for the purpose of providing a safety device configured as a novelty within the field of the application and resolves the aforementioned drawbacks, also providing other additional advantages that will be evident from the accompanying description below.

Therefore, an object of the present invention is to provide a safety device for a chain of a shade which comprises:

- a base element provided with fastening means envisaged to fasten the base element to a vertical surface or wall;

- a tensioning element, in which the chain can be rolled, the tensioning element being linearly slidable through guide means;
- a movable retaining device linked to the tensioning element through a relative movement, such that it defines a free space between the tensioning element and the retaining element, through which the chain runs, the retaining element and the tensioning element being axially aligned, wherein elastic locking means are mounted in contact with the tensioning element;
- elastic shock-absorbing means linked to the retaining element and a stop surface situated on the base element, such that the base element is susceptible to move in relation to the tensioning element.

This way, in a functional condition, the shock-absorbing means and the elastic locking means are in an extended condition, such that the sliding movement of the chain through the tensioning element is locked by the retaining element, while in a second functional condition, the elastic shock-absorbing means and the elastic locking means are compressed, such that a distance is created between the tensioning element and the retaining element which allows for the free sliding of the chain.

Thanks to these characteristics, a tamper-proof safety device is obtained with a structurally simple configuration that is easy to manufacture, which allows for the passing and movement of the chain through the same in a smooth way and without sudden jumps due to the arrangement of the elastic shock-absorbing means, even in the case that the chain has oversized stop elements.

In a preferred embodiment, the previously described elastic shock-absorbing means consist of a helical spring.

Also in a preferred embodiment, the elastic locking means consist of a helical spring.

In accordance with another advantageous characteristic of the invention, the tensioning element is made up of two halves which are able to be coupled to each other by non-loosened fastening means, defining a longitudinal through hole through which the elastic shock-absorbing means pass.

Advantageously, the device of the invention includes a casing cover that can be coupled to the base element, such that the components on the base element are properly protected from manipulation and dirt.

Preferably, the casing cover is made of a plastic material made from injection molding, which facilitates the manufacturing process.

According to another aspect of the invention, the fastening means of the base comprise through holes configured to allow for the passage of screw elements, making the system easy to manufacture and apply.

Advantageously, the base element is provided with guide means configured to guide the movement of the tensioning element.

In a particular embodiment of the invention, the aforementioned guide means comprise rails present on the base element, which can be coupled to slots situated on the tensioning element.

In accordance with another aspect of the invention, the retaining element has a part that is envisaged to be in contact with the chain, made of a metal material, such that the useful life of the piece is extended, reducing the wear of the material caused by contact with the chain or cord.

Also preferably, the tensioning element has a segment with a lowered curved peripheral surface, thereby facilitating the guiding and sliding of the chain or cord through the safety device.

Other characteristics and advantages of the safety device, object of the present invention, will become clear in light of the description of a preferred, though non-exclusive, embodiment, which, by way of a non-limiting example, is illustrated in the accompanying drawings, wherein:

DESCRIPTION OF SPECIFIC EMBODIMENTS OF THE INVENTION

In view of the aforementioned figures and, in accordance with the numbering adopted, an example of a preferred embodiment of the invention can be observed therein, which comprises the parts and elements indicated and described in detail below.

According to a current preferred embodiment of the safety device for a chain (100) of a conventional-type roller shade (not shown), said device comprises a base element (1) made, for example, of a plastic material through injection molding, which is provided with fastening means envisaged to fasten the base element (1) to a vertical surface or wall (not shown).

These fastening means of the base comprise a through hole (2) configured for the passage of a screw element (3) which can be inserted in a hole made in the wall or carpentry of a window.

Figure 1:
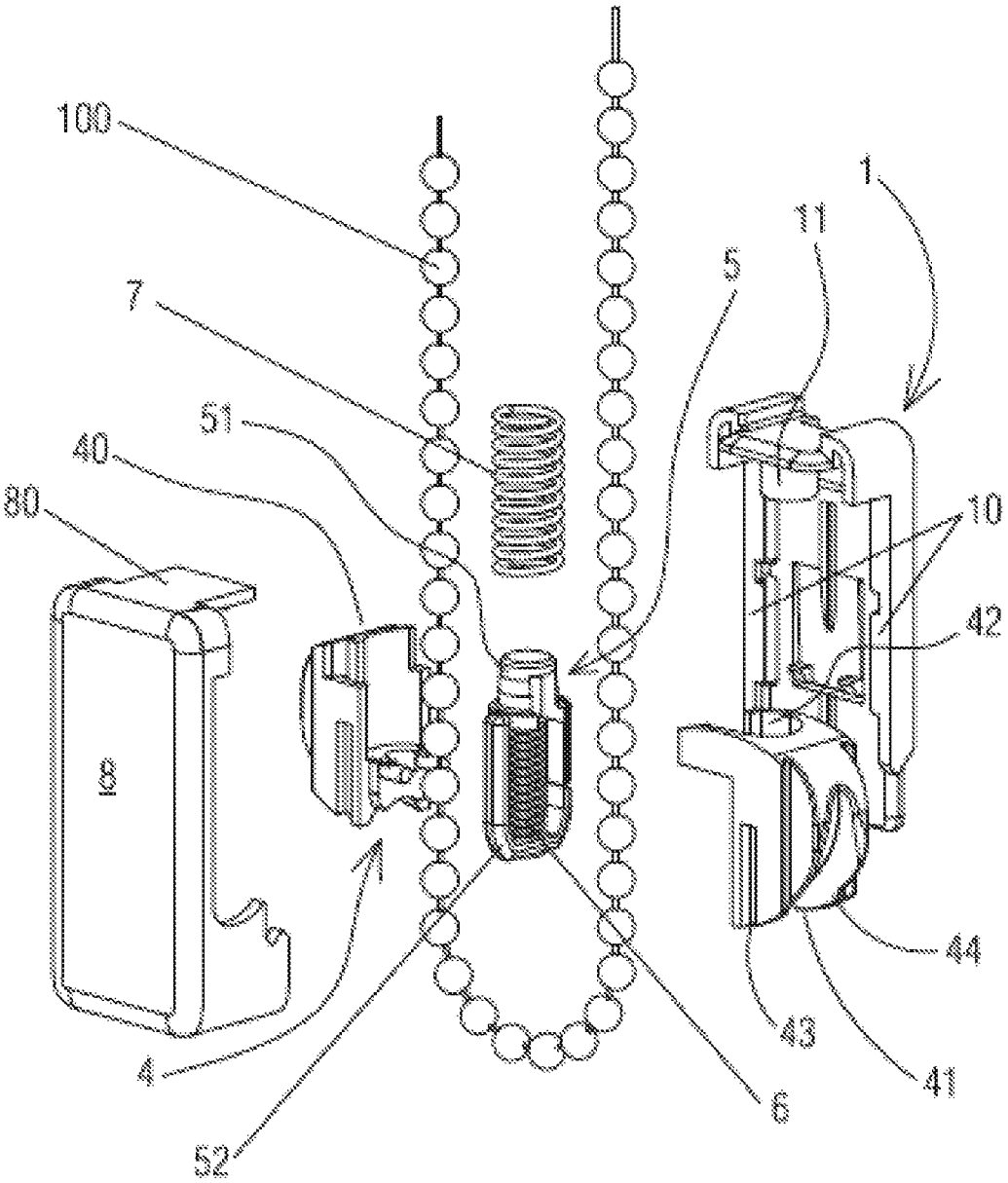
FIG. 1 shows an exploded perspective view of a safety device for a roller shade according to the present invention.

Moreover, a tensioning element (4) in which the chain (100) can be rolled is provided, the tensioning element being linearly slidable through guide means. As can be seen in FIG. 1, the tensioning element is made up of two halves (40, 41) which can be coupled to each other by non-loosened fastening means, each half (40, 41) defining a central through hole (42) which extends longitudinally therethrough. Furthermore, on each one of the two halves (40, 41) thereof, the tensioning element (4) has a section (44) with a lowered curved peripheral surface.

The safety device also includes a movable retaining element (5) which is partially housed inside the central hole (42). During operation, said retaining element (5) is linked to the tensioning element (4) through a relative movement, such that it allows for a free space between the tensioning element (4) and the retaining element (5), through which the chain (100) runs, the retaining element (5) and the tensioning element being axially aligned. A lower part of the retaining element (5) has a curved region which facilitates the passage of the chain (100). Advantageously, the retaining element has an essentially U-shaped piece (52) which is envisaged to be in contact with the chain (100), made of a metal material, providing greater resistance to wear.

Elastic locking means are made up of an elastic spring (6), which is mounted inside the retaining element (5), which is in contact with the tensioning element (4).

Elastic shock-absorbing means, in this case a helical shock-absorber (7) is connected to the retaining element (5) and a stop surface situated in the base element (1). More specifically, this helical shock-absorbing spring (7) is coupled to a projection (51) with an essentially cylindrical shape, which is situated on an end of the retaining element (5) while the opposite end is coupled to a cylindrical protrusion (11) which protrudes from the base element (1).

It is important to mention that the helical shock-absorbing spring (7) has greater dimensions than the elastic spring (6), which form the elastic locking means.

To protect against dirt, blows and manipulation of the previously described elements, a casing cover (8) is provided, made, for example, of a plastic material made by injection molding, which can be coupled to the base element (1) by means of a clipping system, generally indicated by the reference (80).

Returning to the base element (1), said element is provided with guide means configured to guide the movement of the tensioning element. Said guide means comprise a pair of rails (10) separated and present on the base element (1), which are coupled to complimentary slots (43) situated on two opposite sides of the tensioning element (4).

Figure 2A:
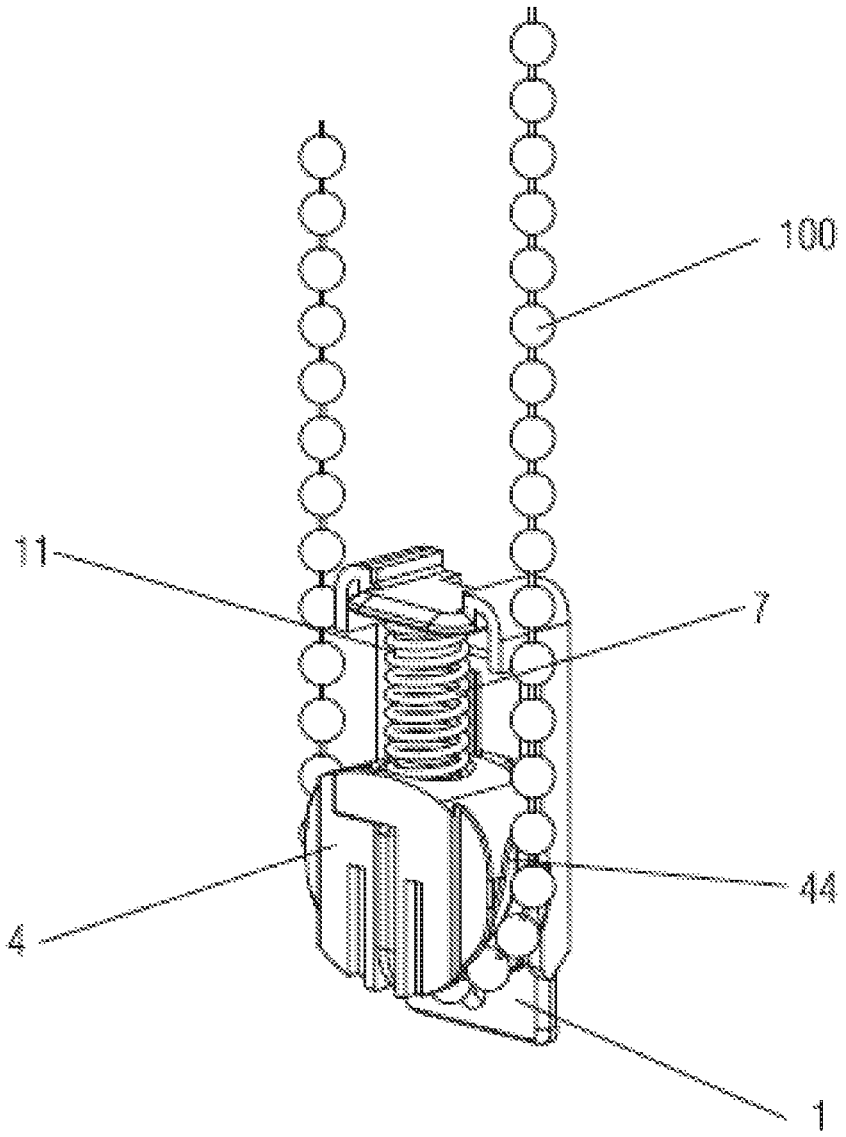
FIGS. 2*a* and 2*b* show cross-sectional elevation and perspective views, respectively, of the device of the invention in a first functional condition wherein the elastic locking means and the elastic shock-absorbing means are in a completely extended condition, and wherein some parts have been removed for the purpose of better clarity.
Figure 2B:
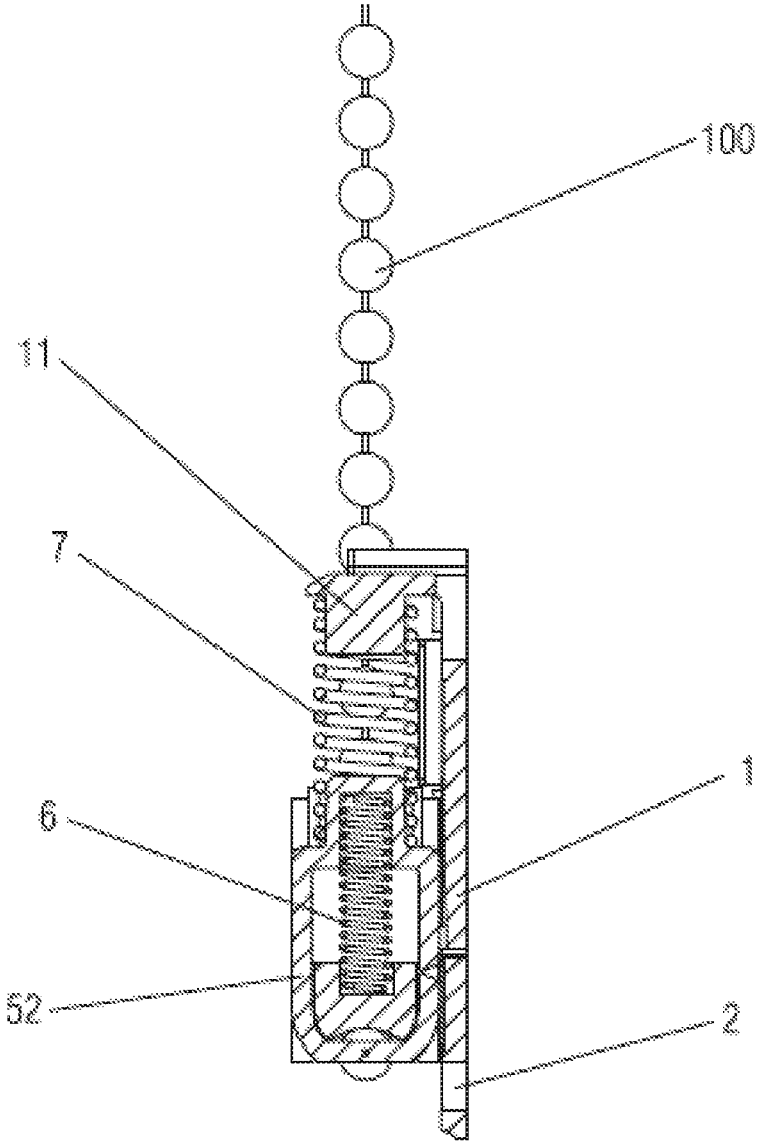

In a functional condition represented in FIGS. 2*a* and 2*b*, in this case in a condition prior to the mounting of the safety device on a vertical wall, the shock-absorbing elastic spring (7) and the elastic spring (6) are in an extended condition, such that the sliding movement of the chain (100) through the tensioning element is blocked by the retaining element (5).

Figure 3A:
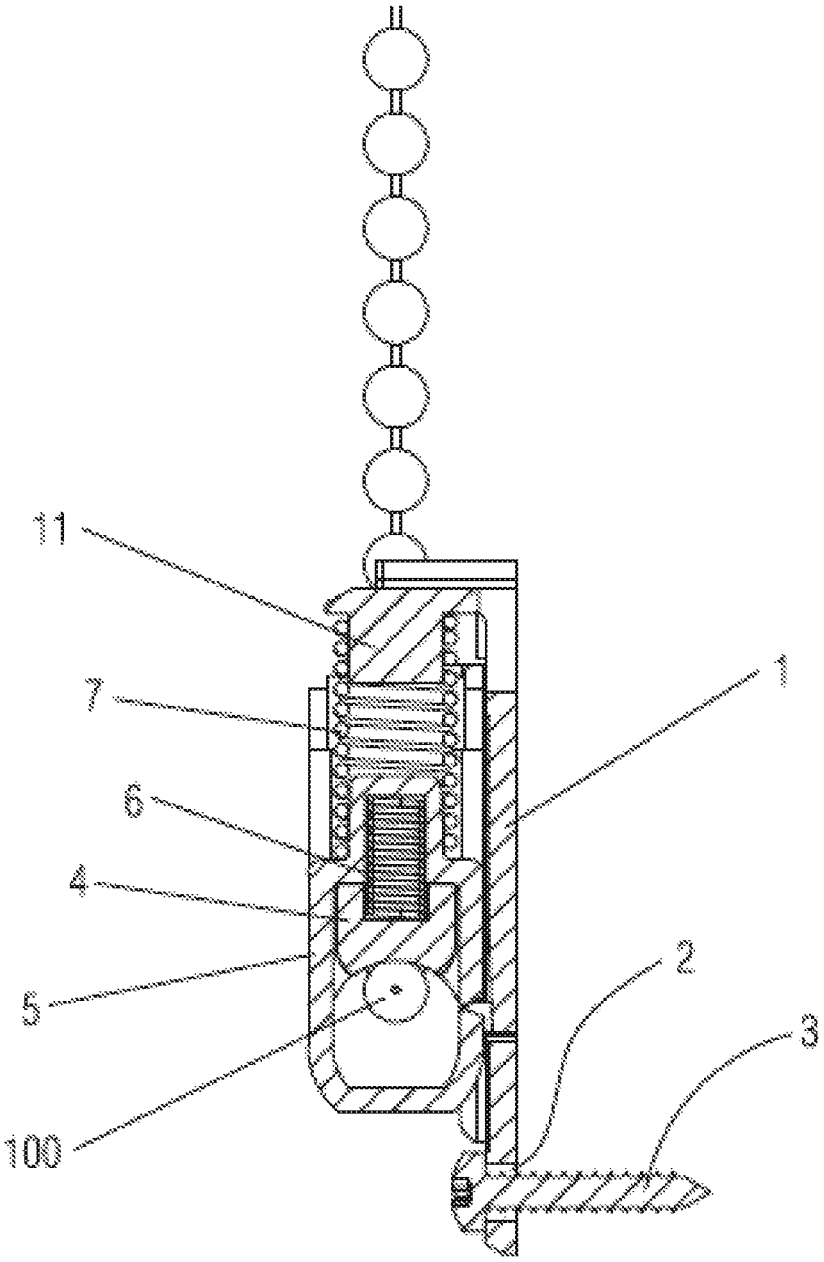
FIGS. 3*a* and 3*b* show cross-sectional elevation and perspective views, respectively, of the device of the invention in a second functional condition and wherein some parts have been removed for the purpose of better clarity.
Figure 3B:
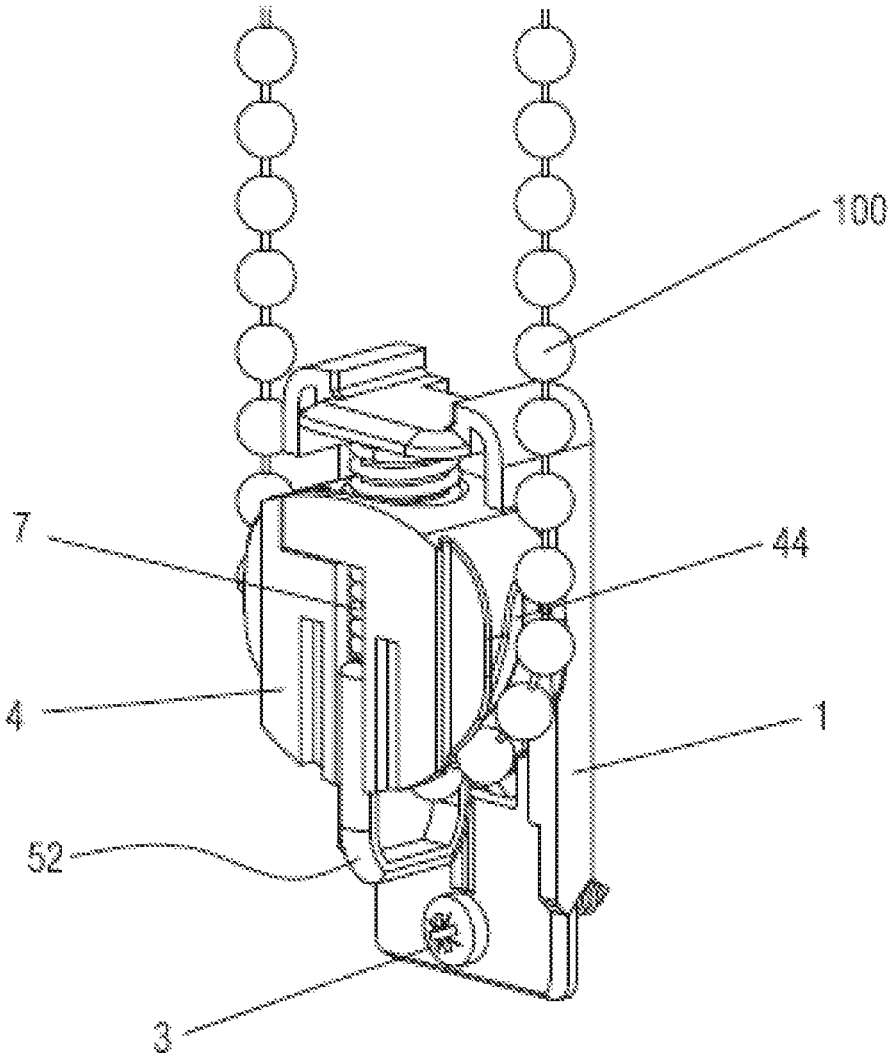

In a second functional conditioned, represented in FIGS. 3*a* and 3*b*, wherein the safety device has already been placed on the wall, the elastic shock-absorbing spring (7) and the elastic spring (6) are compressed, such that (according to the position of the figures) the tensioning element (4) and the retaining element (5) move in a vertically ascending direction, such that a distance is created between the tensioning element (4) and the retaining element (5) which is large enough to allow for the free sliding of the chain (100) for the raising or lowering operations.

Figure 4A:
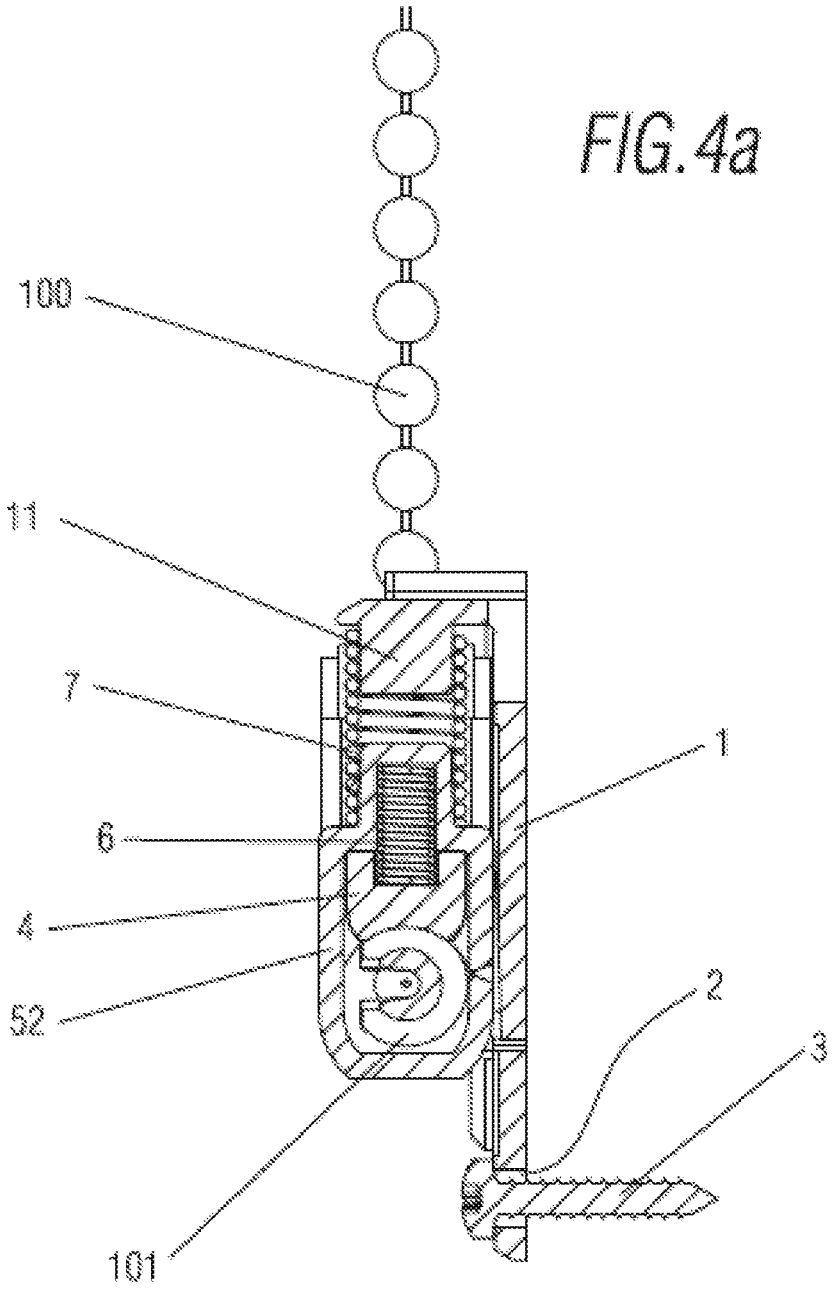
FIGS. 4*a* and 4*b* show cross-sectional elevation and perspective views of the device of the invention in a third functional condition wherein some parts have been removed for the purpose of better clarity.
Figure 4B:
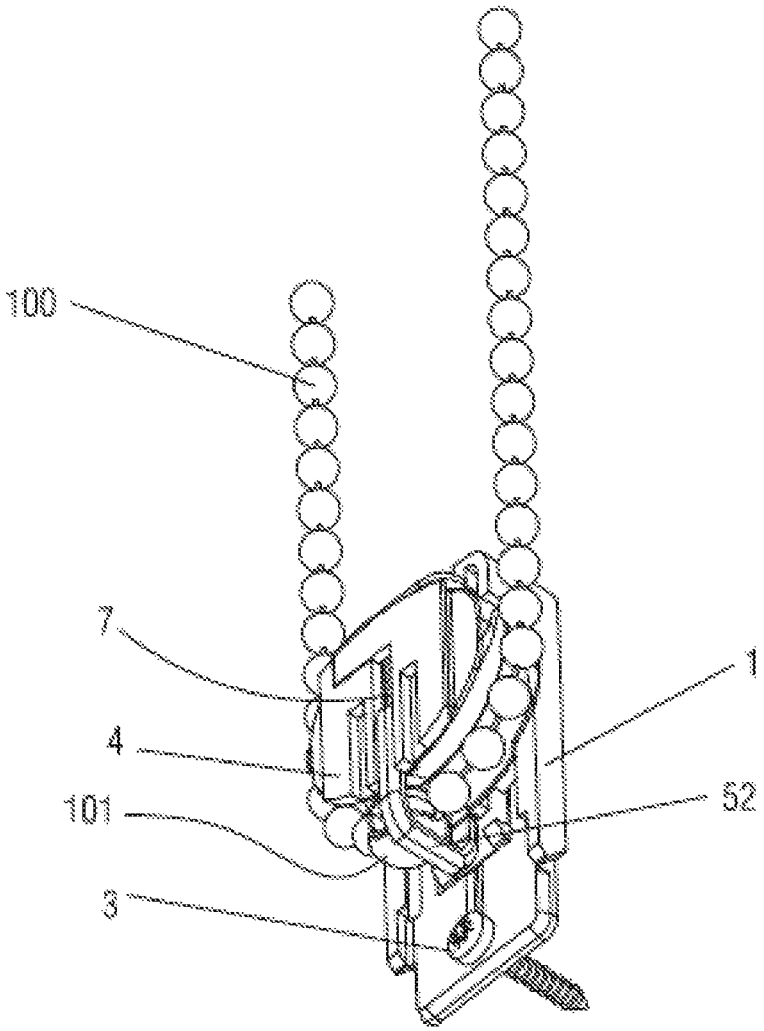

Lastly, FIGS. 4*a* and 4*b* show the arrangement of the elastic shock-absorbing spring (7) and the elastic spring (6) together with the tensioning element (4) and the retaining element (5), when stop means (101) present on the chain (100) pass through the safety device.

The details, shapes, dimensions and other accessory elements used to manufacture the safety device of the invention may be suitably substituted for others which do not diverge from the scope defined by the claims included below.

What is claimed is:

1. A safety device for a chain of a shade, comprising:

a base element provided with fastening means configured to fasten the base element to a vertical surface or wall;

a tensioning element, along which the chain can be rolled, the tensioning element being linearly slidable through guide means;

a movable retaining device linked to the tensioning element, such that a free space is defined between the tensioning element and the retaining device, through which the chain runs, the retaining device and the tensioning element being axially aligned along a vertical axis of the vertical surface or wall, wherein elastic locking means are mounted in contact with the tensioning element;

elastic shock-absorbing means linked to the retaining device and to a stop surface situated on the base element, such that the retaining device is movable in relation to the base element; wherein prior to mounting of the safety device on the vertical surface or wall, the shock-absorbing means and the elastic locking means are in an extended condition, such that sliding movement of the chain along the tensioning element is locked by the retaining device, when the safety device is mounted on the vertical surface or wall, the elastic shock-absorbing means and the elastic locking means are compressed, such that a distance is created between the tensioning element and the retaining device which allows for the free sliding of the chain;

wherein the tensioning element comprises two halves which are fastenable to each other, wherein when the halves of the tensioning element are fastened to each other, a longitudinal through hole is defined therebetween through which the elastic shock-absorbing means pass.

2. The safety device for a chain of a shade according to claim 1, characterized in that the elastic shock-absorbing means consist of a helical spring.

3. The safety device for a chain of a shade according to claim 1, characterized in that the elastic locking means consist of a helical spring.

4. The safety device for a chain of a shade according to claim 1, further comprising a casing cover that can be coupled to the base element.

5. The safety device for a chain of a shade according to claim 4, wherein the casing cover is made of injection molded plastic material.

6. The safety device for a chain of a shade according to claim 1, characterized in that the fastening means for the base comprise a through hole configured to allow for the passage of a screw element.

7. The safety device for a chain of a shade according to claim 1, characterized in that the base element is provided with guide means configured to guide the movement of the tensioning element.

8. The safety device for a chain of a shade according to claim 7, characterized in that the guide means comprise rails present on the base element that can be coupled to slots situated on the tensioning element.

9. The safety device for a chain of a shade according to claim 1, characterized in that the retaining device has a part configured to be in contact with the chain, the chain being made of a metal material.

10. The safety device for a chain of a shade according to claim 1, characterized in that the tensioning element has a segment with a recessed curved peripheral surface.

* * * * *